US005755519A

United States Patent [19]

Klinefelter

[11] Patent Number: 5,755,519

[45] Date of Patent: May 26, 1998

[54] PRINTER RIBBON IDENTIFICATION SENSOR

[75] Inventor: Gary M. Klinefelter, Eden Prairie, Minn.

[73] Assignee: Fargo Electronics, Inc., Eden Prairie, Minn.

[21] Appl. No.: 759,373

[22] Filed: Dec. 4, 1996

[51] Int. Cl.[6] ..... B41J 35/00

[52] U.S. Cl. ..... 400/249; 400/208; 400/223; 400/242

[58] Field of Search ..... 400/207, 208, 400/703, 223, 249, 245, 242, 204

[56] References Cited

U.S. PATENT DOCUMENTS

| | | | |
|---|---|---|---|
| 4,797,018 | 1/1989 | Hofmann et al. | 400/249 |
| 4,810,116 | 3/1989 | Schulze et al. | 400/208 |
| 4,848,276 | 7/1989 | Brännström et al. | 122/245 |
| 4,872,027 | 10/1989 | Buskirk et al. | 346/140 R |
| 4,910,533 | 3/1990 | Sasaki et al. | 346/151 |
| 4,970,531 | 11/1990 | Shimizu et al. | 346/76 DH |
| 5,035,325 | 7/1991 | Kitsuki | 206/459 |
| 5,078,523 | 1/1992 | McGourty et al. | 400/613 |
| 5,079,565 | 1/1992 | Shimizu et al. | 346/76 PH |
| 5,087,137 | 2/1992 | Burnard et al. | 400/249 |
| 5,224,784 | 7/1993 | Haftmann et al. | 400/208 |

*Primary Examiner*—Christopher A. Bennett
*Attorney, Agent, or Firm*—Westman, Champlin & Kelly, P.A.

[57] ABSTRACT

A sensor for sensing and identifying characteristics of a printer ink ribbon when a ribbon supply roll is inserted into a printer and operated. Ink ribbon cartridges used in printers are provided in a number of types, colors, and other identifiable characteristics that are important for insuring that the correct ribbon is inserted in the printer for the then current print job. In the present invention, the ribbon cartridges include ribbon supply rolls which are provided with identifying indicia on one end of the roll, and a sensor to read the presence of indicia when the printer is operated. The positions of the indicia relative to selected reference positions indicates the ink ribbon type. Suitable circuitry is used to disable the printer if the print ribbon is not properly correlated to the requirements of the printer. A Hall Effect Sensor is used adjacent the print roll, and the indicia on the ink ribbon roll comprise pins or similar members that will affect the Hall Effect Sensor output when rotated past the sensor.

15 Claims, 7 Drawing Sheets

38
29A
29
35
34
36
53
58
70
52
42
38
40
20
44
37
41
30
32

PRINTER RIBBON IDENTIFICATION SENSOR

BACKGROUND OF THE INVENTION

The present invention relates to an indicator indicia used with a print ribbon supply roll of a printer, that mounts on the roll and in combination with a sensor identifies a characteristic of the print ribbon placed in the printer for insuring correct printer operation.

Ink ribbon cartridges that are used in thermal printers are well known in the art. The cartridges usually include a casing or housing and at least one spool having a ribbon wound on the spool. The spool is also termed a "roll", and the supply roll will rotate as the ribbon is fed through the printer during the printing operation.

Various kinds of ink ribbons with many different characteristics are available. Thus, insuring that the correct type of ribbon is inserted into the printer for the print job is of concern. For example, waxed ribbons, dye sublimation ribbons, or resin ribbons are available for selected printing jobs, but are not interchangeable. The present invention is illustrated in connection with identifying ribbon types. Each of the ribbon types has many variations that can be separately identified, including color. These variations also can be identified with the present indicator and sensor.

Various ribbon identification devices have been advanced. For example, a device for identifying an ink ribbon cartridge used in a printer is shown in U.S. Pat. No. 5,385,416. It utilizes a photosensor to detect information marks recorded on a ring which has relative motion with respect to the ribbon spool or roll. The identifying information is sensed when the thermal printing head is moved to its operative position in patent '416.

SUMMARY OF THE INVENTION

The present invention relates to identifier indicia carried on a ribbon supply roll placed for indicating the type of ribbon that is on the supply roll which, when placed into a printer, such as a thermal transfer printer and used, will move past a sensor to determine ribbon type or other coded information. The sensor is made so that it will be moved to a sensing position when some component of the printer is moved to make the printer operable. For example the printer cover closing movement can be used for positioning the sensor relative to the indicator indicia carried on the print ribbon roller.

In thermal printers, the supply spools or rolls of the print ribbon are generally part of a cartridge that can be inserted and removed from the printer housing with relative ease. The cartridge rotatably supports the ribbon supply roll, and a take up roll, which is driven as the printer operates. The ribbon on the ribbon supply roll or spool will be pulled from the supply roll by the take up roll as the printer operates, and thus the supply roll rotates as ribbon is pulled off.

In the present invention, one end of the supply roll is provided with a core insert that has a plurality of annularly spaced identifier indicia comprising sensor activating components, which move past a stationary sensor to provide a signal from the sensor when one of the activating components at the annular positions moves past the sensor. The sensor activating are positioned in one or more of a number of annular locations that are at known positions relative to a reference point. Axially extending openings or bores in the ribbon supply roll core, that will receive pins as inserts provide a way of easily placing the sensor activating components at known annular locations. The use of inserts has the additional benefit of being visually identifiable by looking at the ribbon supply roll core to see where the inserts are located. An operator can visually identify the ribbon to be provided to the sensor, if desired.

The ribbon type identification can be accomplished also by having a number of Hall Effect Sensors positioned aligned with the bores for the magnetic pins. The change in condition of the individual Hall Effect Sensors caused by the indicia at selected locations indicates ribbon type without rotating the roll. Thus, ribbon type indicator signals would be available as soon as the ribbon cartridge is installed.

The opposite end of the ribbon supply roll from the sensor activating components is provided with an encoder, which as shown is a disk with a number of open slots and a transducer that includes a light source and receiver on opposite sides of the disk. The encoder will indicate the rotational position of the ribbon supply roll to the printer controls as well as how much ribbon has been removed. Once the printer cover is closed in the form shown, the ribbon type will be sensed when the ribbon rotates. The sensing of the position of the ribbon supply roll and the amount of ribbon removed also can be done by driving the roll with a stepper motor which is controlled in precise counted steps.

The ribbon identification apparatus provides signals that preferably are provided to the printer controller, so that for a particular program for a print the ribbon supply roll and the amount of ribbon removed can be done by driving the roll with a stepper motor which is controlled in precise counted steps.

The ribbon identification apparatus provides signals that preferably are provided to the printer controller, so that for a particular program for a print job, the code for a desired ribbon is encoded into the controller, and the signals from the ribbon identification sensor are also fed to the controller and compared with the desired code to make sure that the inserted ribbon is the appropriate ribbon for the task.

The present preferred embodiment of the invention minimizes the number of magnets used and the magnets are separate from the roller cores so there is no hazardous material thrown away with discounted ribbon rolls. While binary codes could be used, more magnets are required. Although the pins disclosed can be inserted right in the core of the ribbon roll, the replaceable hub also reduces metal pin waste. The magnetic sensor eliminates problems with aligning bar codes and bar code readers, and problems with unreliable light signals for optical sensors. Thus, an easily used, reliable and efficient sensor is provided by the present invention.

DETAILED DESCRIPTION OF THE PREFERRED EMBODIMENTS

Figure 1:
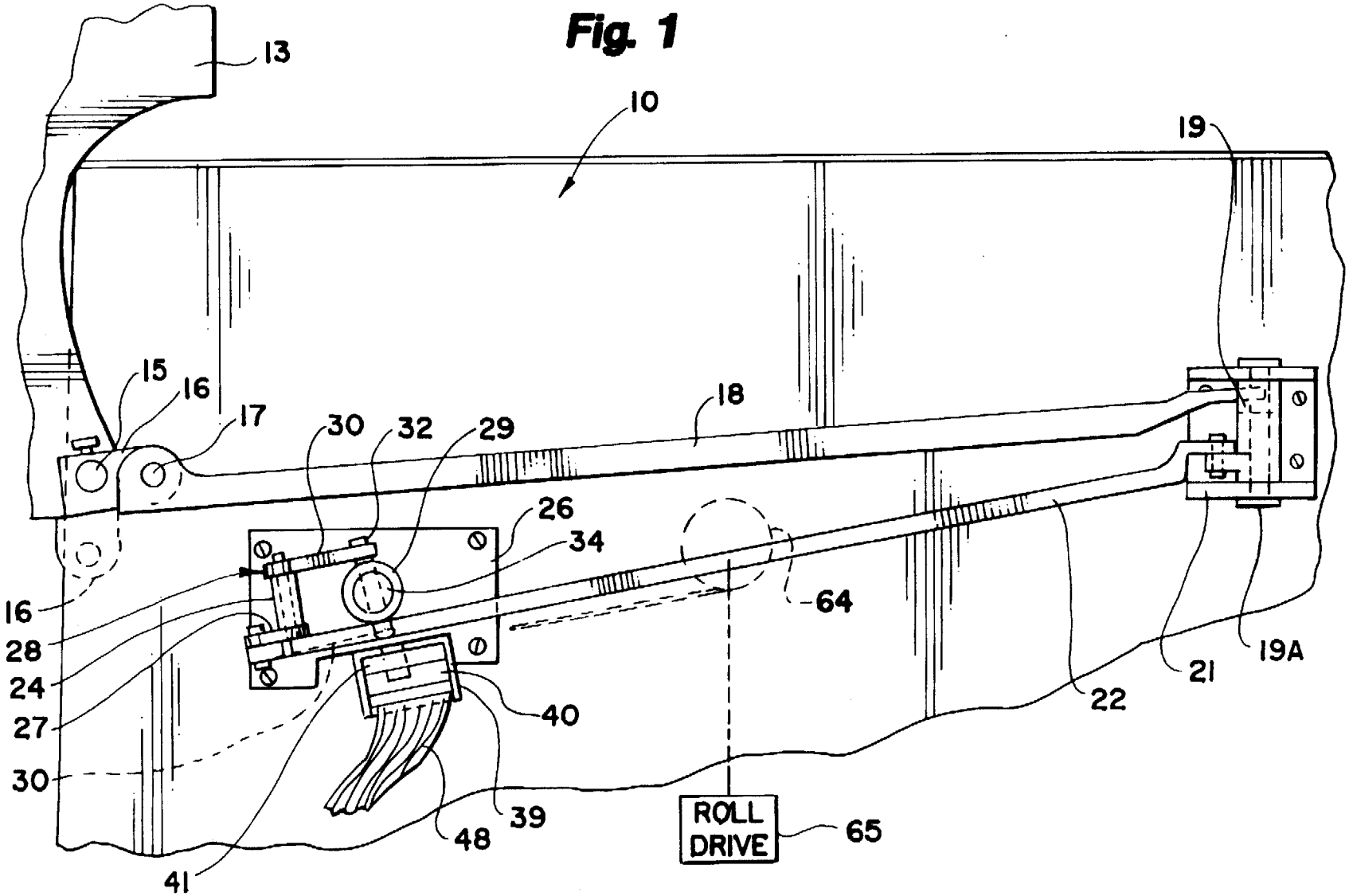
FIG. 1 is a schematic side elevational view of the exterior of a printer schematically showing an operating link for the print ribbon identification sensor.

Referring to FIG. 1, a printer housing 10 is used for mounting a printer ribbon cassette. The printer has print heads operating in a normal manner. The housing 10 as shown has a cover 13 that is pivotally mounted on a suitable pin 15 on opposite side walls of the printer in a conventional manner. The cover 13 is movable from an open position shown in FIG. 1 to a closed position covering the printer ribbon that is installed inside the housing.

Figure 2:
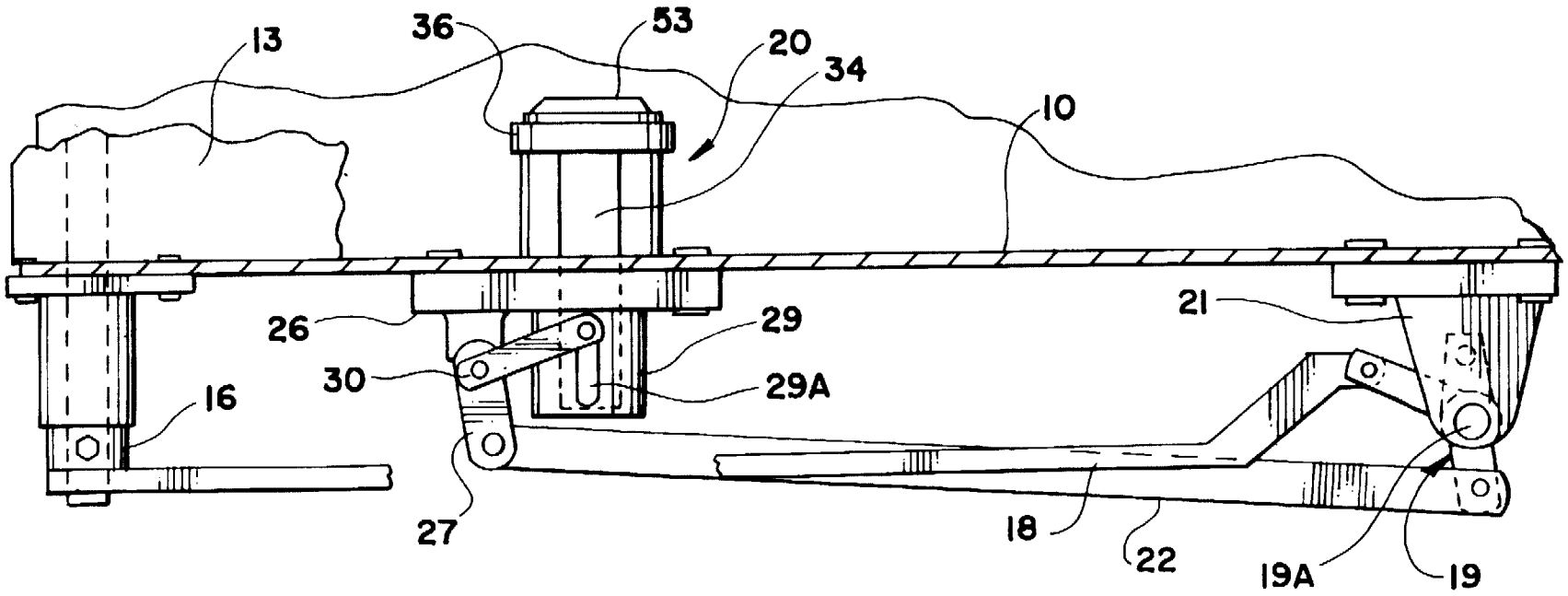
FIG. 2 is a schematic top view of the linkage arrangement shown in FIG. 1.
Figure 3:
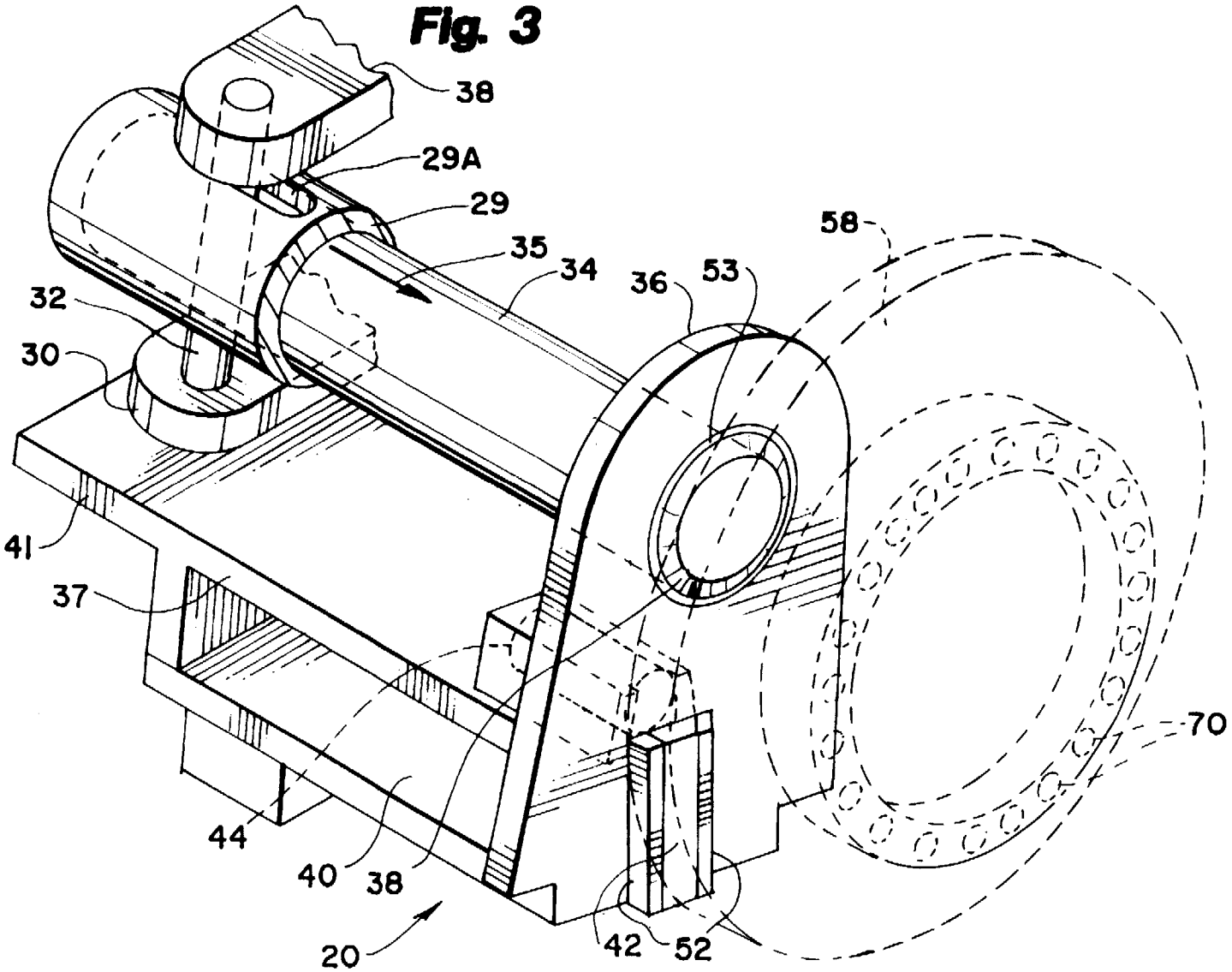
FIG. 3 is a perspective view of a print ribbon identification system made according to the present invention.
Figure 4:
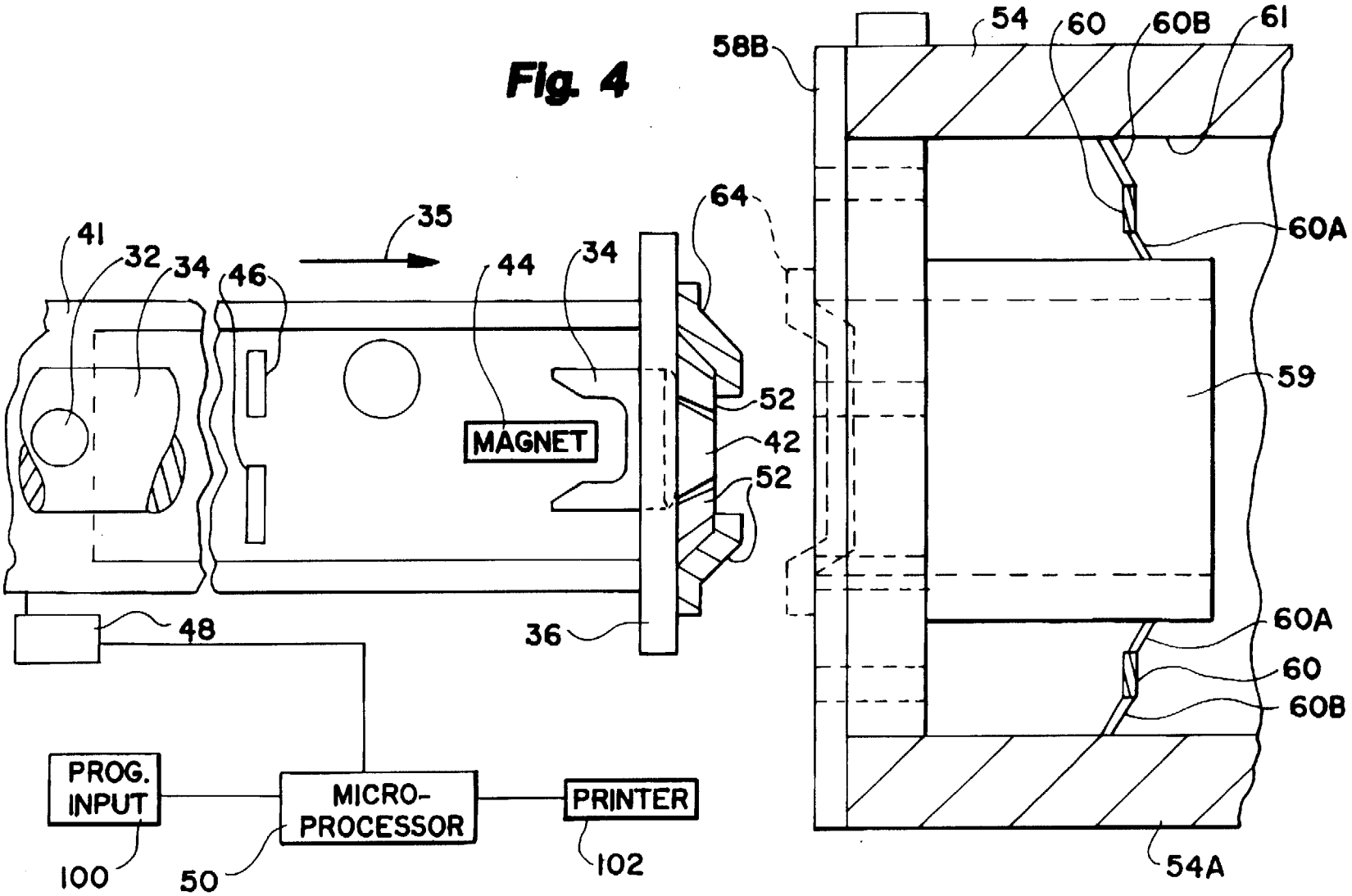
FIG. 4 is an enlarged schematic top plan sectional view showing the ribbon supply roll in position adjacent to a sensor of the present invention and prior to moving the sensor to a working position.

The motion of the cover 13 is used for actuating a printer ribbon identification sensor or detector assembly shown generally at 20 (FIGS. 2, 3, and 4). The pin 15 rotates with the cover 13, and a lever 16 is drivably mounted on the end of pin 15 on the exterior of the printer housing. The lever 16 has its outer end pivotally connected as at 17 to a link 18 that extends along the side of the printer housing to a first arm of a bell crank 19. The bell crank 19 pivots on shaft 19A, which is supported on a hub support 21 to the printer housing. The bell crank 19 is pivoted by the link 18 when the cover 13 is opened or closed. The bell crank 19 has a second arm that moves when link 18 moves and which is connected to drive a link 22 that extends back toward the pin 15 for the cover 13. Link 22 inclines downwardly toward a support 24 for the sensor assembly 20 on the exterior of the side wall of housing 10. A support bracket 26 on the housing 10 is used for pivotally mounting a second bell crank 28. The second bell crank 28 includes an arm 27 pivotally connected to one end of the link 22. The bell crank 28 has a pair of second arms 30 that are vertically spaced so they are at the top and bottom of a support hub 29 formed on the support 24. The outer ends of arms 30 are pivotally mounted onto a vertically extending drive pin 32 secured to a horizontally slidable main mounting shaft 34 used for supporting the sensor assembly 20. The main mounting shaft is slidably supported in the hub 29.

This arrangement is schematically shown, and any suitable type of drive for moving the sensor assembly 20 to and from its operative position can be utilized. As shown in FIG. 3, the arm 30 is connected to the top end of drive pin 32 and the second arm 30 is connected to the bottom end of the drive pin 32 on the outside of hub 29. The vertical drive pin 32 extends through an opening in the mounting shaft 34 and is perpendicular to the longitudinal axis of mounting shaft 34, can be seen in FIG. 3, where the housing side wall has been broken away. The hub 29 has slots shown at 29A at the top and bottom for guiding the pin 32 as it moves and in turn slides shaft 34 in its axial direction. The drive pin 32 is on the exterior of the side wall of the printer housing 10.

When the cover 13 is shut, pin 15 rotates and the lever 16 moves to its dotted line position shown in FIG. 1, and the position shown in FIG. 2, and causes the actuation of the links and bell cranks to move the pin 32 in a direction toward the exterior surface side wall of the printer cover, as indicated by the arrow 35 in FIG. 3. This moves the detector or sensor assembly into an operative position relative to the ribbon supply roll.

Figure 5:
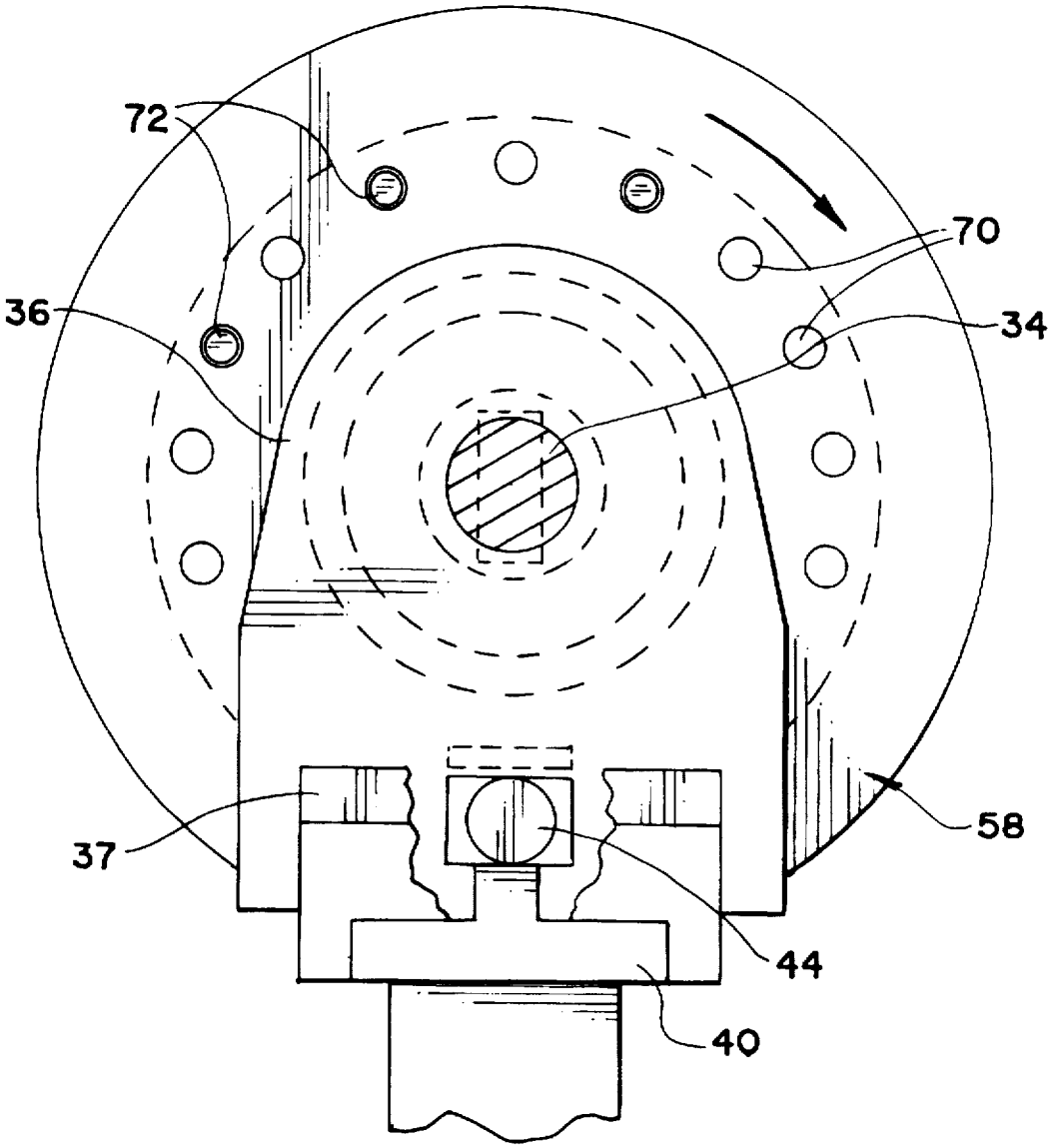
FIG. 5 is an end view of the sensor with the wall of the printer housing or cabinet removed for clarity.

The sensor assembly 20 includes a magnetic sensor mounting plate 36 (FIGS. 3, 4, and 5) which is supported on an end of the mounting shaft 34. The plate 36 has a downwardly extending wall portion 38 that supports one end of a circuit board assembly 40. The circuit board assembly 40 can be made in any desired configuration, but is fixed to the support plate 36 and to a horizontal support member 37 so that they move together.

The circuit board assembly 40 extends from wall 38 back toward drive pin 32 and extends through an aperture 39 in the side wall of the housing 10 (FIG. 1). The support member 37 has a tab 41 that is supported on drive pin 32. The circuit board 40 carries a Hall Effect Sensor 42 (see FIGS. 3 and 4), which is supported by the plate 36. The circuit board 40 also supports a magnet 44 adjacent the Hall Effect Sensor as well as various electronic components indicated generally at 46 for controlling and operating the Hall Effect Sensor 42. The side wall of the printer cabinet has an opening large enough to permit the circuit board assembly to move back and forth with support shaft 34. The components 46 are connected with a suitable connector and ribbon cable shown at 48 to control circuitry including a microprocessor control 50.

The plate 36 has forwardly projecting portions 52 at its lower end that hold the Hall Effect Sensor 42. A supply roll pilot guide 53 is fixed to plate 36 in horizontal alignment with a print ribbon supply roll 54 when such roll is seated for use in the printer. The pilot guide 53 positions and seats the Hall Effect Sensor 42 relative to an end of the print ribbon supply roll 54.

Thus, it can be seen that when the printer cover 13 is closed and the linkage moved the shaft 34, the bracket 36, the circuit board 42, and various components supported therewith will move from a position shown in FIG. 4, to a position where the pilot guide 53 is in its dotted position shown in FIG. 4, with the Hall Effect Sensor 42 then moved up closely adjacent an end magnetic sensor core 58 that is mounted in the tubular core 54A of print ribbon supply roll 54.

The print ribbon supply roll 54 is shown in cross section in FIG. 4, and it can be seen that the magnetic sensor core 58 pilots inside the roll core 54A, and has a hub 59 that extends into the interior of the print ribbon supply roller core 54A a selected amount. The ribbon is wrapped around the outside of the core 54A, and as it is pulled off the roll, the roll rotates, as does hub 59. The drive to the ribbon take up roll 64 which pulls ribbon 66 of the supply roll 54 and rotates the ribbon supply roll 54 is shown in FIG. 2. The take up roll is part of the ribbon cassette.

The hub 59 is held in place with a suitable toothed retainer 60. The retainer 60 is a ring that has teeth 60A on its inner periphery that engage the outer surface of the hub 58 and teeth 60B at is outer periphery that engage an inner surface 61 of the bore of the print ribbon supply roll core 54A. The ring 60 will securely hold the magnetic sensor core hub 59 in the tubular ribbon supply roll core 54A. As shown, the magnetic sensor core 58 is machined so that there is a shoulder formed at its outer end that closely fits in the bore of the core 54A. An outer flange 58B bears against the end of the ribbon supply roll core 54A for positioning. The magnetic sensor core 58 has an internal axial bore of size to receive the pilot guide 53 that is mounted on the plate 36 to position the Hall Effect Sensor properly relative to the axis of rotation of the ribbon supply roll 54.

The Hall Effect Sensor 42 is positioned radially outward near the inner surface of the bore of the ribbon supply roll core 54A. The sensor assembly is moved adjacent to an outer end surface of the magnetic sensor core 58. The magnetic sensor core 58 has a plurality of apertures 70 arranged around the periphery thereof, just to the inside of the wall of the bore of the ribbon roller core 54A. The apertures 70 are of size to receive pins 72 that can be fitted or detented into the apertures so they do not fall out. The pins 72 can thus be held in place in the selected bores to be used. The pins 72 are of a material that has magnetic properties, that is a ferromagnetic material or some plastic that includes magnetic material particles. The pins are put into selected apertures for purposes of providing identification of the type of ribbon on the ribbon supply roll that is in place.

It can be seen that with the magnet 44 adjacent to and on the opposite side of the Hall Effect Sensor 42 from the pins 72, as a pin 72 moves past the Hall Effect Sensor 42 the magnetic flux lines at the Hall Effect Sensor will be disrupted or changed when the pins pass by, causing a current output pulse from the Hall Effect Sensor 42. The bracket 36 and the magnetic sensor core 58 in the printer ribbon supply roll core 54A are made of nonmagnetic materials, such as suitable plastic, so that they do not affect the magnetic flux lines as the ribbon supply roll rotates.

The circuit board components 46 sense changes in the condition of the Hall Effect Sensor 42 and condition the Hall Effect Sensor signals to provide an output signal to the microprocessor 50.

Figure 6:
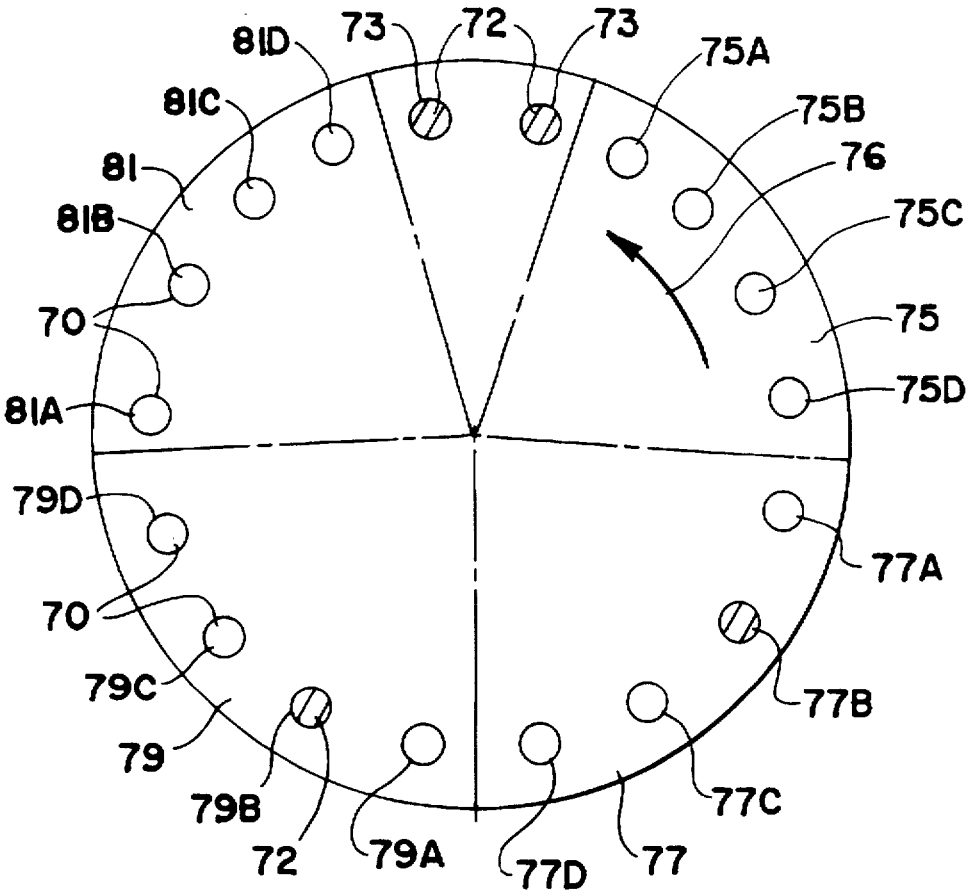
FIG. 6 is a schematic representation showing the apertures for markers or indicia in the core of the ribbon supply roll.

As shown in FIG. 6, the magnetic sensor core 58 that is mounted in the bore of ribbon supply roller core 54A is shown with eighteen apertures or bores 70 around its periphery. The bores 70 as shown, are divided into four sectors for ribbon identification in addition to a home position. The two bores shown at 73 are always filled with pins 72 or otherwise plugged. The bores 73 form the "Home" or start sector. The two pins in the adjacent bores 73 indicate the start of a cycle for determining the type of ribbon carried on the ribbon supply roll. When the Hall Effect Sensor 42 senses these two markers or pins there will be two pulses in a short rotational span received by the controller and to indicate that the subsequent sequence of pulses indicates the type of ribbon on the supply roll.

The position of the ribbon supply roll is also encoded, as will be explained, so the spacing of the signals from the pins in bores 73 will be correlated to separately encoded rotational or angular movement signals. The "start" signal is thus not affected by speed of rotation.

The four remaining sectors of the pins in the magnetic sensor core are for ribbon identification. The first sector is shown at 75 when the supply roll is rotationally leading additional bores, 77A, 77B and 77C that optionally can carry pins or be left open as shown.

The third sector 79 on the magnetic sensor core likewise has a rotationally last or trailing permanently unplugged or open bore 79D and rotationally leading bores 79A, 79B and 79C that can carry pins, for example the pin 72 shown in bore 79B to indicate a particular ribbon type.

The fourth active sector 81 has a last or rotationally trailing permanently open bore 81D and rotationally leading bores 81A, 81B and 81C that can carry pins (or other indicators) or be left open for the desired indication of ribbon type or characteristics.

It can be seen that a wide variety of indicators can be utilized with this number of openings. The indicia are on an annular path, as shown, bores divided into sectors, for sensing positions of indicators to provide information on ribbon types.

Figure 7:
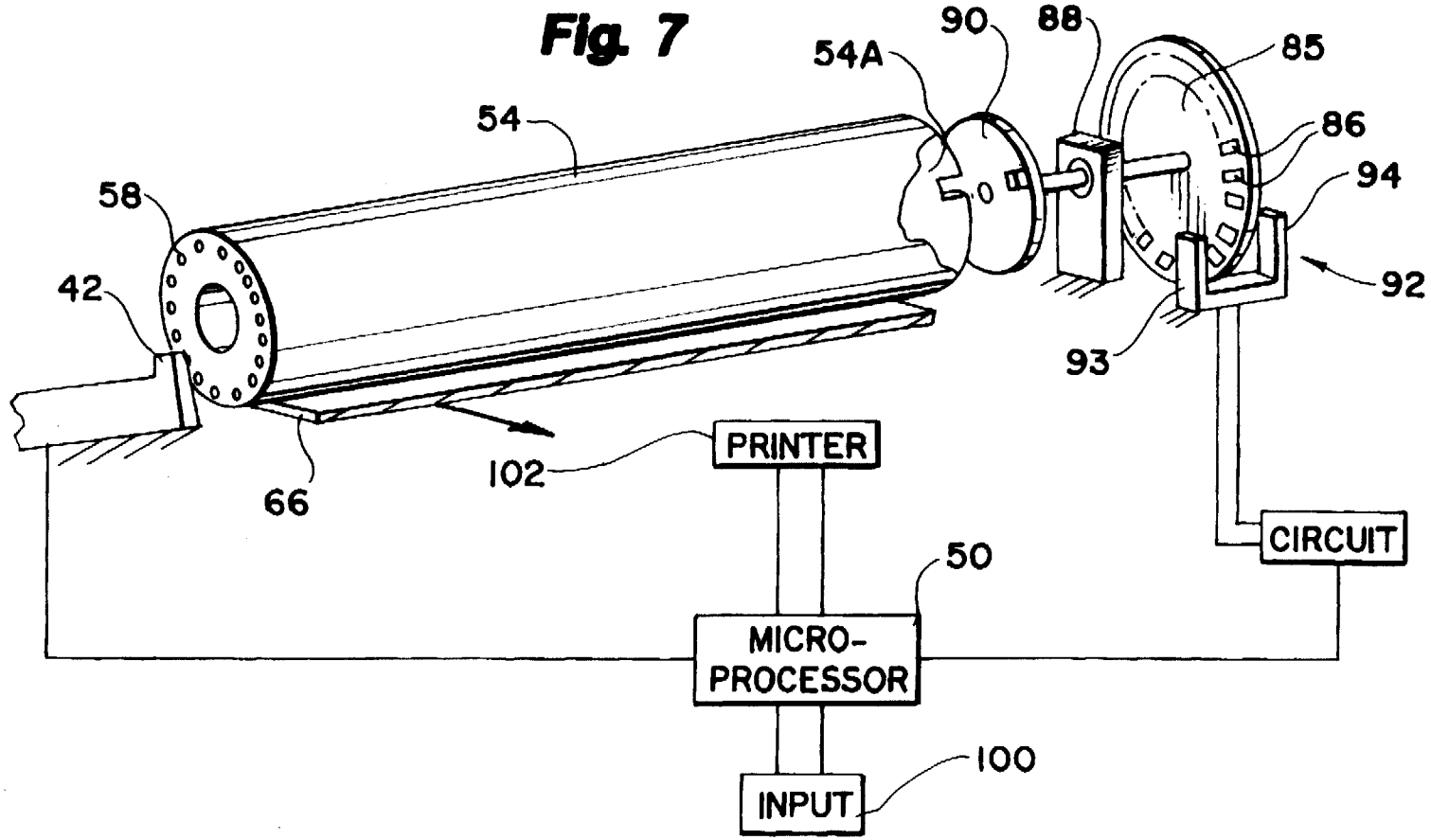
FIG. 7 is a schematic representation of an encoder that is mounted onto an opposite end of the ribbon supply roll and which is used for providing information about ribbon supply roll position and amount of movement.

In FIG. 7 there is a schematic showing of a printing ribbon supply roll, and illustrating a typical encoder for providing information on roll rotation and position that is driven by the roll when the supply roll is rotated. This type of encoder is shown only schematically because it is well known, and it includes a wheel 85 that is rotatably mounted on a suitable support 88. The wheel 85 has a number of light transmitting apertures shown schematically at 86 around the periphery, separated by opaque or light blocking segments. The wheel 85 is supported for rotation with the ribbon supply roll. A drive coupler 90 is provided with suitable keys that will interfit with end slots in the core 54A of the ribbon supply roll. The wheel 85 is driven by the ribbon supply roll when the drive parts are engaged. The drive parts are shown separated in FIG. 7 for illustrative purposes, and sake of clarity.

An optical sensor shown schematically at 92 is mounted in the printer housing, and it includes a light source 93 and a receiver 94 such as a light sensitive diode, so that each time an opening 86 moves between the light source and the receiver there is a pulse that indicates the rotational position of the ribbon supply roll. The number of pulses received by circuitry 96 indicates the total rotation. The signals are provided to the microprocessor 50 used for controlling printer operation. The ribbon roll position can be providing from a stepper motor drive, as well.

The microprocessor 50 has a program input 100 that is used for an input control for driving the printer 102 and operating the printing cycle. As part of the program input, an indication of the type of ribbon to be used is encoded into the microprocessor with the printer control program, and if the inputted signals do not match the signals obtained from the circuitry 46 as determined by the Hall Effect Sensor 42, the program will stop the printer and provide a warning that the wrong ribbon is in place.

It should be noted that circuitry used with the Hall Effect Sensor is conventional, and generally includes a comparator so that there will be a pulse provided when the signal level reaches or exceeds a reference level. The signal would occur when a pin 72 carried in one of the apertures in the magnetic sensor core 58 moves past the Hall Effect Sensor.

The hub inserted into the ribbon supply roll core provides a novel support for indicator indicia, and in particular with movable indicia, supportable at known location around the periphery of the hub. The use of pins, in particular provides visual identification as well.

The sensor or detector signals are digital and thus easily identified and compared to insure the proper ribbon is installed.

The linkage shown for causing the sensor assembly 20 to move toward the ribbon roll when the printer cover is closed may be removed and a spring attached to the sensor assembly to urge it toward its active position. The sensor assembly can merely be moved manually out of the way while the ribbon roll is installed, and then permitted to snap back to usable position under spring load. Other types of mechanisms may be used as well.

Although the present invention has been described with reference to preferred embodiments, workers skilled in the art will recognize that changes may be made in form and detail without departing from the spirit and scope of the invention.

What is claimed is:

1. For use with a printer having a print ribbon supply roll having a ribbon thereon which is one of a plurality of ribbon types, the improvement comprising identifier indicia for the particular type of ribbon on the supply roll assembly including individually removable and replaceable ferromagnetic inserts on an end face of the supply roll assembly positioned at selected known locations around a central axis, and a detector mounted adjacent the end of the supply roller assembly including a permanent magnet and a Hall Effect Sensor spaced from the inserts and supply roll assembly and providing an output signal based on movement of identifier indicia past the detector.

2. The improvement of claim 1, wherein the supply roll assembly has a plurality of supports for the ferromagnetic inserts greater than the plurality of inserts, the inserts being replaceable on each of the supports in a selected plurality of combinations.

3. The improvement of claim 1, wherein the identifier indicia includes a home position identifier for initiating a sequence of identification signals by the detector in each revolution of the print ribbon supply roll assembly.

4. The improvement of claim 1, wherein the improvement further comprises a plurality of apertures formed in the end face of the supply roll assembly and oriented to move past the detector when the supply roll rotates, the apertures being supports for the inserts and permitting removing and replacing inserts therein.

5. A printer of a type which utilizes one of a plurality of available ink ribbons on an ink ribbon supply roll, and the supply roll including an ink ribbon identifier comprising a hub mountable on the ink ribbon supply roll and rotatable therewith;

a plurality of supports on an end of the hub spaced annularly around a periphery of the hub at known intervals;

a plurality of magnetic material pins removably mounted on selected ones of the supports; and a detector mounted on the printer comprising a magnet and a Hall Effect Sensor between the magnet and the end of the hub, the Hall Effect Sensor facing an end surface of the hub and providing a signal which changes when a pin moves past the detector.

6. The apparatus of claim 5, wherein the plurality of supports comprise bores including at least one bore that has a unique characteristic for identifying a home position, and a plurality of sectors defined around the periphery of the hub, each of the sectors having a plurality of bores.

7. The apparatus of claim 5, wherein said detector is mounted on a support, and said support being movably mounted on the printer and movable from a first position adjacent the hub on the ribbon supply roll to a second position spaced from the hub.

8. An ink ribbon supply roll comprising a roll core, a plurality of supports comprising a first support and a plurality of second supports formed in a member movable with the roll core and radially spaced from an axis of rotation of the roll core when the roll core rotates as ribbon thereon is removed, and first identifier indicia comprising an unmagnetized magnetic material in a first support to indicate a home position, the second supports other than the being oriented at known positions relative to the home position and at least one second support carrying a removable unmagnetized magnetic material identifier indicia.

9. The ink ribbon supply roll of claim 8, wherein the supports comprise apertures for receiving the identifier indicia.

10. The ink ribbon supply roll of claim 9, wherein the identifier indicia metal pins that slip into the apertures.

11. The ink ribbon supply roll of claim 9, wherein said roll core is tubular and said apertures are formed in a hub that has a surface fitting within an inner surface of the tubular roll core.

12. The ink ribbon supply roll of claim 8, wherein the first identifier indicia are formed on two adjacent supports, said adjacent supports being in a first sector, the supports other than the two adjacent supports being arranged in four sectors, said sectors each containing a plurality of supports in an annular arc having a leading support, and a selected support in each sector which is maintained free of identifier indicia, while other supports in each sector are available for selectively supporting identifier indicia.

13. The ink ribbon supply roll of claim 12 and an encoder coupled to said roll core for providing pulsing signals to indicate rotation of said roll core at discrete intervals.

14. The ink ribbon supply roll of claim 10 in combination with a detector comprising a Hall Effect Sensor mounted on a frame mounting the supply roll and having a magnetic field established there around, said Hall Effect Sensor being positioned adjacent the supports and in alignment with the supports as the roll core rotates past the detector.

15. The ink ribbon supply roll of claim 14, further comprising a microprocessor for receiving signals from the detector to indicate the type of ribbon on the roll core as the roll core rotates past the detector, and an input device providing information to the microprocessor relating to the desired type of ribbon for a printing operation, the microprocessor providing an output indicating when the ribbon indicated by the identifier indicia is the same as that indicated by the input device.

* * * * *

UNITED STATES PATENT AND TRADEMARK OFFICE

CERTIFICATE OF CORRECTION

PATENT NO. : 5,755,519

DATED : May 26, 1998

INVENTOR(S) : Gary M. Klinefelter

It is certified that error appears in the above-identified patent and that said Letters Patent is hereby corrected as shown below:

Column 6, line 61

Claim 1, line 1, after "roll" insert --assembly.

Column 8, line 15

Claim 10, line 2, after "indicia" insert --comprise--.

Signed and Sealed this

Twenty-seventh Day of October, 1998

*Attest:*

Bruce Lehman

BRUCE LEHMAN

*Attesting Officer*

*Commissioner of Patents and Trademarks*